US007347385B2

(12) United States Patent
Boecking

(10) Patent No.: US 7,347,385 B2
(45) Date of Patent: Mar. 25, 2008

(54) FUEL INJECTION DEVICE WITH A 3-WAY CONTROL VALVE FOR CONFIGURING THE INJECTION PROCESS

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/532,626

(22) PCT Filed: May 30, 2003

(86) PCT No.: PCT/DE03/01763

§ 371 (c)(1),
(2), (4) Date: Apr. 25, 2005

(87) PCT Pub. No.: WO2004/048769

PCT Pub. Date: Jun. 10, 2004

(65) Prior Publication Data

US 2006/0043210 A1 Mar. 2, 2006

(30) Foreign Application Priority Data

Nov. 23, 2002 (DE) ..... 102 54 749

(51) Int. Cl.
*F02M 41/16* (2006.01)

(52) U.S. Cl. ..... 239/96; 239/88; 239/124; 239/533.2; 239/90

(58) Field of Classification Search ..... 239/88, 239/90, 533.2, 533.8, 585.1, 585.4, 585.5, 239/96, 124
See application file for complete search history.

(56) References Cited

U.S. PATENT DOCUMENTS 2,680,651 A * 6/1954 Berlyn ..... 239/87
5,669,355 A * 9/1997 Gibson et al. ..... 123/446
6,427,968 B1 8/2002 Stoecklein
6,616,062 B2 * 9/2003 Boecking ..... 239/96
6,745,953 B2 * 6/2004 Boecking ..... 239/96
6,749,129 B2 * 6/2004 Hefler et al. ..... 239/88
6,749,130 B2 * 6/2004 Cotton ..... 239/89
6,814,302 B2 * 11/2004 Stoecklein et al. ..... 239/98
6,871,801 B2 * 3/2005 Kienzler et al. ..... 239/533.2
2002/0074423 A1 * 6/2002 Boecking ..... 239/88
2002/0134853 A1 * 9/2002 Stoecklein et al. ..... 239/88
2003/0052187 A1 * 3/2003 Boecking ..... 239/124

FOREIGN PATENT DOCUMENTS

DE 100 30 119 A1 12/2000

(Continued)

*Primary Examiner*—Dinh Q. Nguyen
*Assistant Examiner*—Trevor McGraw
(74) *Attorney, Agent, or Firm*—Ronald E. Greigg

(57) ABSTRACT

A fuel injection device for internal combustion engines, having a control valve located between high-pressure and low-pressure sides and which opens or blocks the communication of a control chamber with the low-pressure side, and an outlet throttle located between the control valve and the low-pressure side, the control valve having a first valve position, in which the communication of the control chamber with the low-pressure side is blocked, a second valve position, in which the control chamber communicates with the low-pressure side via a first outlet conduit, and a third valve position, in which the control chamber communicates with the low-pressure side via a second outlet conduit having an outlet throttle.

20 Claims, 4 Drawing Sheets

FOREIGN PATENT DOCUMENTS

| | | | |
|---|---|---|---|
| DE | 100 39 215 | A1 | 2/2002 |
| DE | 101 32 501 | A1 | 10/2002 |
| EP | 1 164 283 | A2 | 12/2001 |
| FR | 2 824 109 | A1 | 10/2002 |
| FR | 2 824 112 | A1 | 10/2002 |
| WO | WO 03/004856 | A1 | 1/2003 |

* cited by examiner

FUEL INJECTION DEVICE WITH A 3-WAY CONTROL VALVE FOR CONFIGURING THE INJECTION PROCESS

CROSS-REFERENCE TO RELATED APPLICATIONS

This application is a 35 USC 371 application of PCT/DE 03/01763 filed on May 30, 2003.

BACKGROUND OF THE INVENTION

1. Field of the Invention

The invention is directed to an improved fuel injection device for internal combustion engines.

2. Description of the Prior Art

In a fuel injection device of the type with which this invention is concerned, known for instance from German Patent Disclosure 100 39 215 A1, the nozzle needle of a fuel injection valve is opened or closed as a function of the pressure prevailing in a control chamber. The control chamber, connected permanently to the high-pressure side, can communicate with the low-pressure side by means of a 2/2-way control valve embodied as a double seat valve and can thereby be pressure-relieved. However, in this fuel injection device, injection course shaping is not possible.

SUMMARY AND ADVANTAGES OF THE INVENTION

The fuel injection device of the invention has the advantage over the prior art that the pressure prevailing in the control chamber is suppressed variously quickly by activation or deactivation of the outlet throttle, and injection course shaping can therefore be performed.

Further advantages and advantageous features of the subject of the invention are disclosed.

BRIEF DESCRIPTION OF THE DRAWINGS

Two preferred exemplary embodiments of the fuel injection device of the invention are described herein below, with reference the drawings, in which.

DESCRIPTION OF THE PREFERRED EMBODIMENTS

Figure 1:
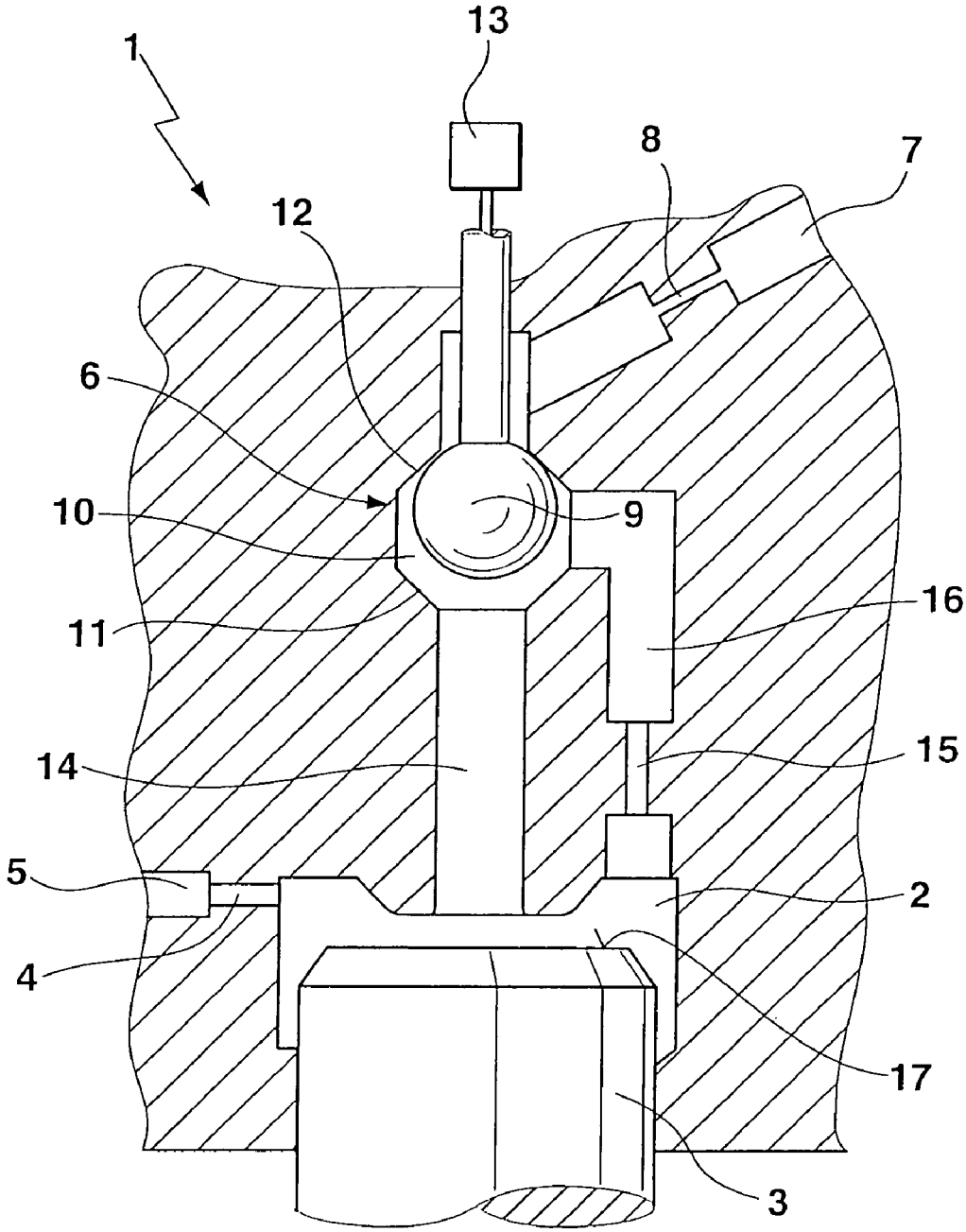
FIG. 1 schematically illustrates the fuel injection device of the invention, with a double seat valve, which controls the pressure in a control chamber, in its upper valve position.

The fuel injection device 1 shown in FIG. 1 is typically used in an internal combustion engine having a plurality of cylinders, with one fuel injection valve (injector) assigned to each of these cylinders. This injector, in a manner known per se, has an injection nozzle, not shown here in detail, that protrudes into a cylinder combustion chamber of the engine, and a nozzle needle 3, here suggested by only a small part of it, that opens and closes the injection nozzle as a function of the pressure in a control chamber 2.

The control chamber 2 is permanently connected via an inlet throttle 4 to a high-pressure inlet line (high-pressure side) 5. For controlling the injection event, a 3/3-way control valve 6 in the form of a double seat valve is provided, which opens or blocks the communication of the control chamber 2 with a low-pressure outlet line (low-pressure side) 7. The high-pressure inlet line 5 may communicate with a high-pressure reservoir (common rail), not shown, and the low-pressure outlet line 7 may communicate with leak fuel. An outlet throttle 8 is located in the low-pressure outlet line 7.

The control valve 6 has a valve body 9, embodied as a valve ball, which is axially adjustable in a valve chamber 10 between two coaxial, annular valve seats 11, 12, by means of an actuator 13, for instance a piezoelectric actuator. The lower valve seat 11, in terms of FIG. 1, is provided between a first outlet conduit 14 of the control chamber 2 and the valve chamber 10, and the upper valve seat 12 is provided between the valve chamber 10 and the low-pressure outlet line 7. The valve chamber 10 is permanently connected to the control chamber via a second outlet conduit 16 that has an outlet throttle 15; the outlet throttle 15 on the high-pressure side has a greater throttle resistance, for instance a smaller throttling opening, than the outlet throttle 8 on the low-pressure side. By means of the actuator 13, the valve body 9 can be displaced into an upper, middle, or lower valve position.

In the upper valve position, shown in FIG. 1, of the valve body 9, the valve opening of the upper valve seat 12 is closed by the valve body 9, and the valve opening of the lower valve seat 11 is open, so that the communication of the control chamber 2 with the low-pressure side is blocked. The high pressure that prevails in the control chamber 2 engages a control face 17 of the nozzle needle 3 that acts in the closing direction of the nozzle needle 3, so that the nozzle needle 3 and the fuel injection valve are closed.

Figure 2:
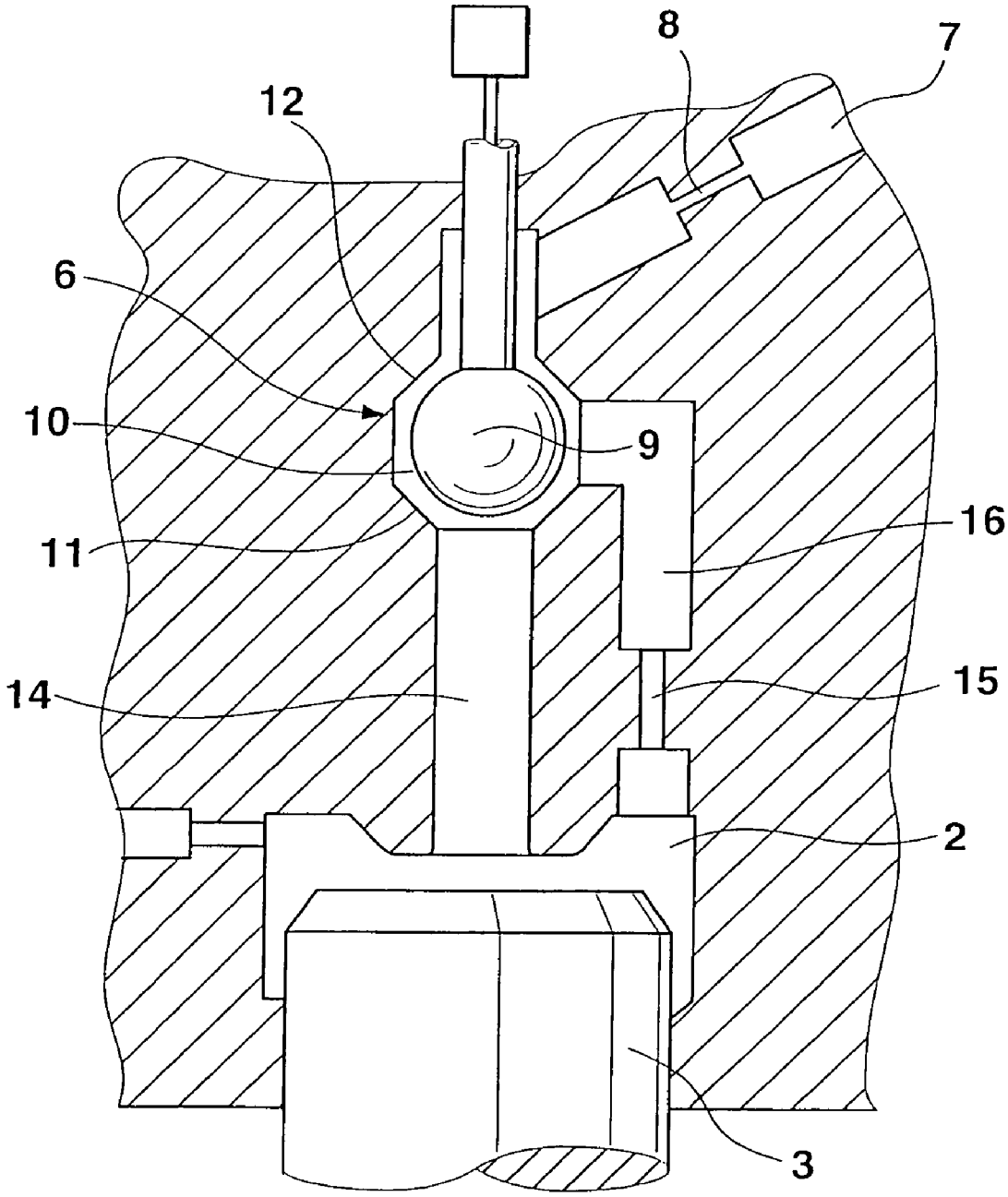
FIG. 2 shows the double seat valve of FIG. 1, in its middle valve position.

In the middle valve position shown in FIG. 2, the valve body 9 is located between two valve seats 11, 12, so that the valve openings of both valve seats 11, 12 are open. The control chamber 2 communicates with the low-pressure outlet line 7 via both outlet conduits 14, 16, so that the pressure prevailing in the control chamber 2 is lowered, and the nozzle needle 3 and the fuel injection valve open. Because of the outlet throttle 15, the pressure suppression from the control chamber 2 into the valve chamber 10 is effected primarily via the first relief conduit 14, so that the speed of pressure suppression is determined primarily by the outlet throttle 8 on the low-pressure side.

Figure 3:
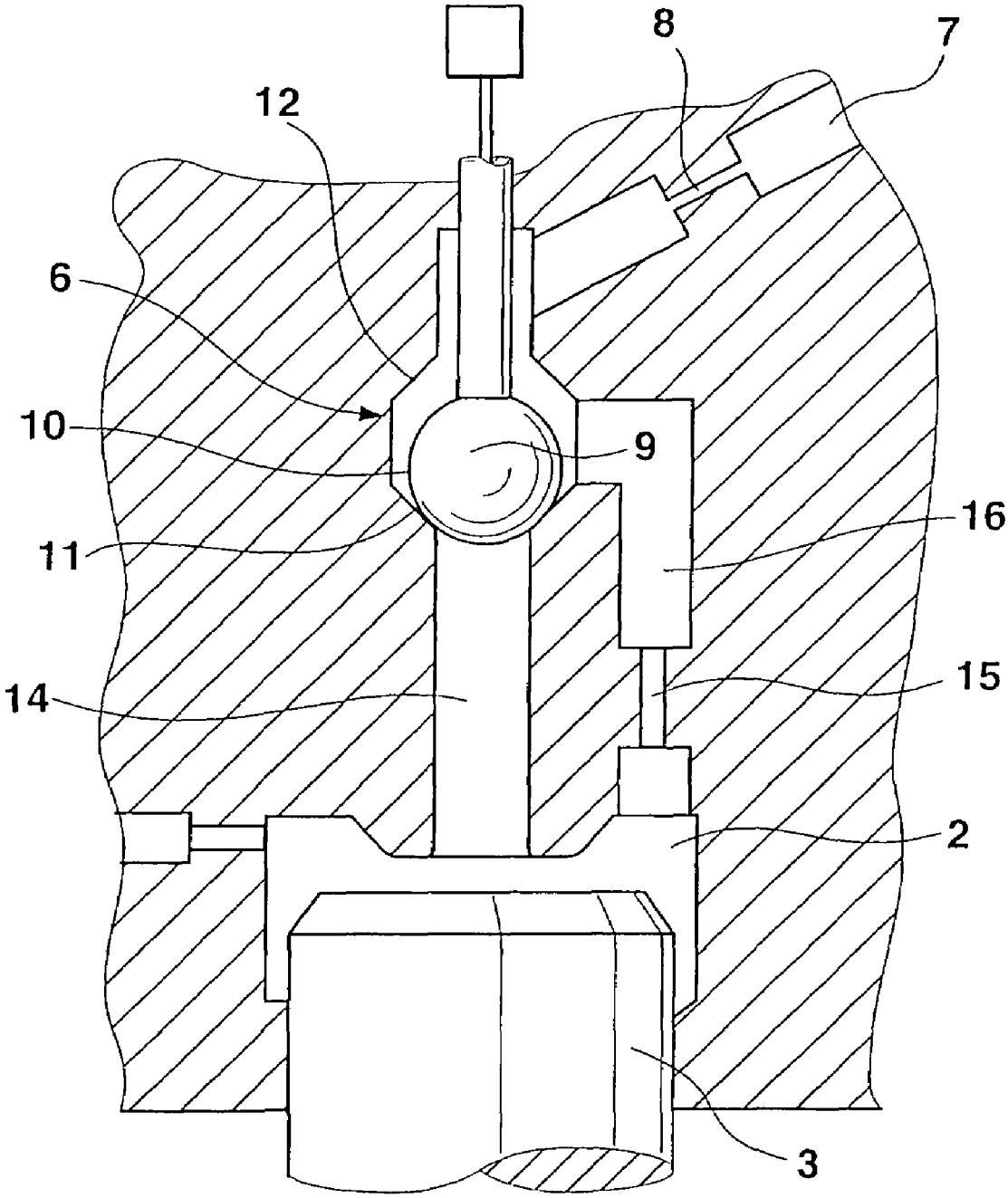
FIG. 3 shows the double seat valve of FIG. 1, in its lower valve position.

In its lower valve position shown in FIG. 3, the valve body 9 closes the valve opening of the lower valve seat 11, and as a result the pressure suppression from the control chamber 2 into the valve chamber 10 is effected solely via the second relief conduit 16. The pressure suppression speed is determined primarily, because of its greater throttle resistance, by the outlet throttle 15 on the high pressure side.

Since the pressure prevailing in the control chamber 2 is suppressed variously quickly in the middle and lower valve positions of the valve body 9, it is possible, by a suitable combination of the two outlet throttles 8, 15 and the inlet throttle 4, to establish a desired injection course shaping by means of the control valve 6.

Figure 4:
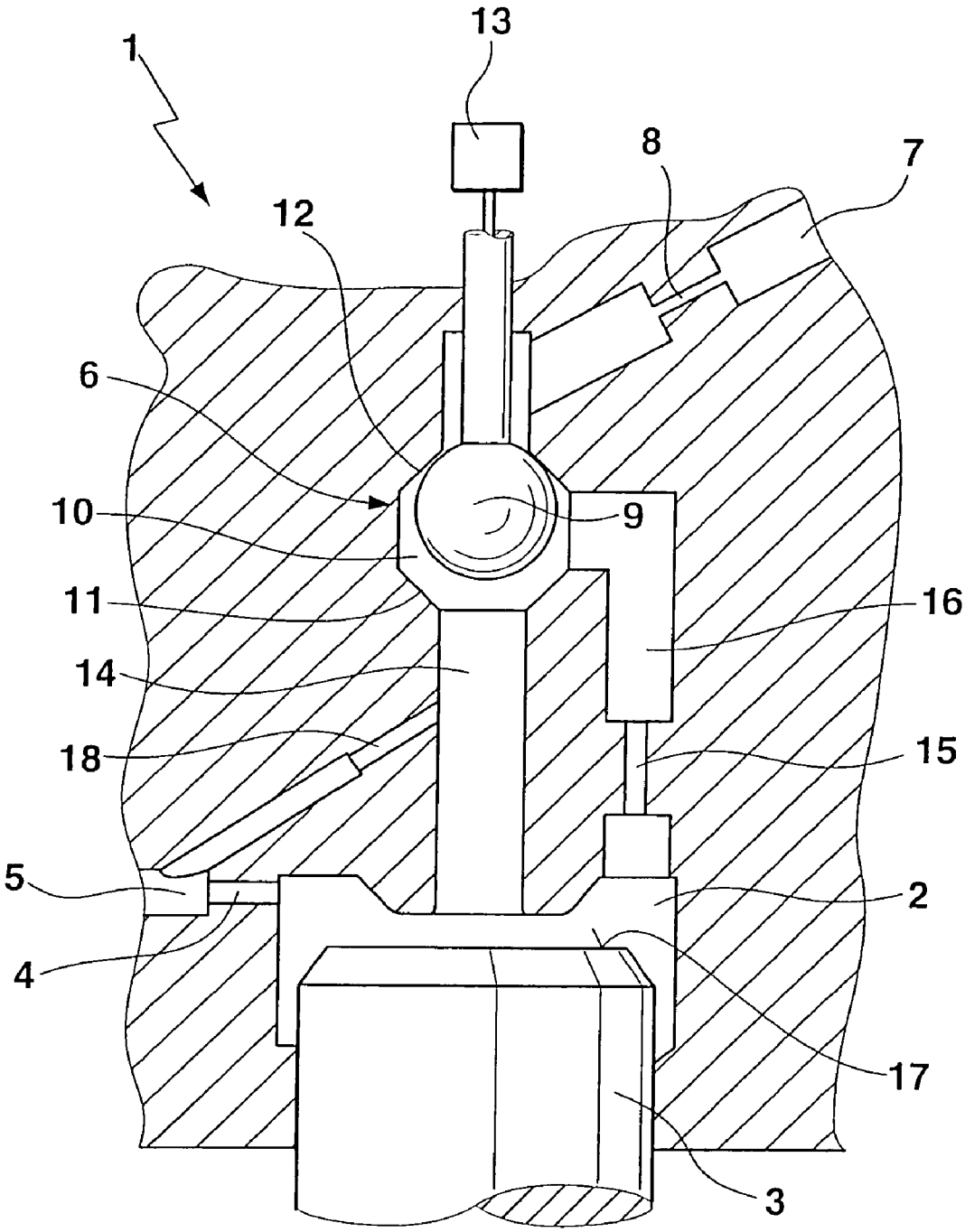
FIG. 4 shows the fuel injection device of FIG. 1, with one additional inlet throttle.

The variant shown in FIG. 4 differs from the fuel injection device of FIG. 1 in that the first outlet conduit 14 is connected directly to the inlet line 5 via a further inlet throttle 18. In the lower and middle valve positions of the valve body 9, this inlet throttle 18 acts as a bypass. In the lower valve position of the valve body 9, the inlet throttle 18 acts in series with the outlet throttle 15 on the high-pressure side, and as a result this outlet throttle can be adapted very finely to the two inlet throttles 4, 18. At the transition of the valve body 9 to its upper valve position, the inlet throttle 18, since the pressure in the first relief conduit 14 is suppressed more slowly, exerts an additional closing force in the direction of the first valve position, so that the control valve 6 closes faster.

The foregoing relates to a preferred exemplary embodiments of the invention, it being understood that other variants and embodiments thereof are possible within the spirit and scope of the invention, the latter being defined by the appended claims.

The invention claimed is:

1. A fuel injection device for internal combustion engines, comprising, a control chamber (2), a control valve (6) having first, second and third valve positions, the control valve (6) being located between a high-pressure side (5) and a low-pressure side (7) and being operable to open or block the communication of the control chamber (2) with the low-pressure side (7), an outlet throttle (8) located between the control valve (6) and the low-pressure side (7), and means (13) moving the control valve (6) between its first, second and third positions the control valve (6) blocking the communication of the control chamber (2) with the low-pressure side (7) in its first position, the control chamber (2) communicating with the low-pressure side (7) via a first outlet conduit (14) when the control valve (6) is in its second position, and the control chamber (2) communicating with the low-pressure side (7) via a second outlet conduit (16) providing a second, alternative flow path from the control chamber (2) to the low-pressure side (7) when the control valve (6) is in its third position, said second outlet conduit (16) having an outlet throttle (15).

2. The fuel injection device of claim 1, wherein the outlet throttle (15) of the second outlet conduit (16) has a higher throttle resistance than the outlet throttle (8) on the low-pressure side.

3. The fuel injection device of claim 1, wherein in the second valve position, the control chamber (2) communicates with the low-pressure side (7) via the second outlet conduit (16) as well.

4. The fuel injection device of claim 2, wherein in the second valve position, the control chamber (2) communicates with the low-pressure side (7) via the second outlet conduit (16) as well.

5. The fuel injection device of claim 1, wherein the control valve (6) is embodied as a double seat valve, with a valve body (9) that is axially adjustable in a valve chamber (10) between two valve seats (11, 12), and one valve seat (11) communicates with the first outlet conduit (14), the other valve seat (12) communicates with the low-pressure side (7), and the valve chamber (10) communicates with the second outlet conduit (16).

6. The fuel injection device of claim 2, wherein the control valve (6) is embodied as a double seat valve, with a valve body (9) that is axially adjustable in a valve chamber (10) between two valve seats (11, 12), and one valve seat (11) communicates with the first outlet conduit (14), the other valve seat (12) communicates with the low-pressure side (7), and the valve chamber (10) communicates with the second outlet conduit (16).

7. The fuel injection device of claim 3, wherein the control valve (6) is embodied as a double seat valve, with a valve body (9) that is axially adjustable in a valve chamber (10) between two valve seats (11, 12), and one valve seat (11) communicates with the first outlet conduit (14), the other valve seat (12) communicates with the low-pressure side (7), and the valve chamber (10) communicates with the second outlet conduit (16).

8. The fuel injection device of claim 4, wherein the control valve (6) is embodied as a double seat valve, with a valve body (9) that is axially adjustable in a valve chamber (10) between two valve seats (11, 12), and one valve seat (11) communicates with the first outlet conduit (14), the other valve seat (12) communicates with the low-pressure side (7), and the valve chamber (10) communicates with the second outlet conduit (16).

9. A fuel injection device for internal combustion engines, comprising, a control chamber (2), a control valve (6) having first, second and third valve positions, the control valve (6) being located between a high-pressure side (5) and a low-pressure side (7) and being operable to open or block the communication of the control chamber (2) with the low-pressure side (7), an outlet throttle (8) located between the control valve (6) and the low-pressure side (7), and means (13) moving the control valve (6) between its first, second and third positions the control valve (6) blocking the communication of the control chamber (2) with the low-pressure side (7) in its first position, the control chamber (2) communicating with the low-pressure side (7) via a first outlet conduit (14) when the control valve (6) is in its second position, and the control chamber (2) communicating with the low-pressure side (7) via a second outlet conduit (16) providing a second, alternative flow path from the control chamber (2) to the low-pressure side (7) when the control valve (6) is in its third position, said second outlet conduit (16) having an outlet throttle (15) wherein the control chamber (2) is connected to the high-pressure side (5) via an inlet throttle (4), which has a lesser throttle resistance than the outlet throttle (15) of the second outlet conduit (16).

10. The fuel injection device of claim 2, wherein the control chamber (2) is connected to the high-pressure side (5) via an inlet throttle (4), which has a lesser throttle resistance than the outlet throttle (15) of the second outlet conduit (16).

11. The fuel injection device of claim 3, wherein the control chamber (2) is connected to the high-pressure side (5) via an inlet throttle (4), which has a lesser throttle resistance than the outlet throttle (15) of the second outlet conduit (16).

12. The fuel injection device of claim 5, wherein the control chamber (2) is connected to the high-pressure side (5) via an inlet throttle (4), which has a lesser throttle resistance than the outlet throttle (15) of the second outlet conduit (16).

13. The fuel injection device of claim 1, wherein the first outlet conduit (14) is connected to the high-pressure side (5) via an inlet throttle (18).

14. The fuel injection device of claim 2, wherein the first outlet conduit (14) is connected to the high-pressure side (5) via an inlet throttle (18).

15. The fuel injection device of claim 3, wherein the first outlet conduit (14) is connected to the high-pressure side (5) via an inlet throttle (18).

16. The fuel injection device of claim 5, wherein the first outlet conduit (14) is connected to the high-pressure side (5) via an inlet throttle (18).

17. The fuel injection device of claim 9, wherein the first outlet conduit (14) is connected to the high-pressure side (5) via an inlet throttle (18).

18. The fuel injection device of claim 5, wherein the means moving the valve body (9) between the first, second and third valve positions comprises a piezoelectric actuator (13).

19. The fuel injection device of claim 16, wherein the means moving the valve body (9) between the first, second and third valve positions comprises a piezoelectric actuator (13).

20. A fuel injection device for internal combustion engines, comprising, a control chamber (2), a control valve (6) having first, second and third valve positions, the control valve (6) being located between a high-pressure side (5) and a low-pressure side (7) and being operable to open or block the communication of the control chamber (2) with the low-pressure side (7), an outlet throttle (8) located between the control valve (6) and the low-pressure side (7), and means (13) moving the control valve (6) between its first, second and third positions the control valve (6) blocking the communication of the control chamber (2) with the low-pressure side (7) in its first position, the control chamber (2) communicating with the low-pressure side (7) via a first outlet conduit (14) when the control valve (6) is in its second position, and the control chamber (2) communicating with the low-pressure side (7) via a second outlet conduit (16) having an outlet throttle (15) when the control valve (6) is in its third position, whereby when the control valve (6) is in its third position, fuel flows from the control chamber (2) to the low-pressure side (7) through the second outlet conduit (16) and its outlet throttle (15).

* * * * *